US010781411B2

(12) United States Patent
Bartley et al.

(10) Patent No.: US 10,781,411 B2
(45) Date of Patent: Sep. 22, 2020

(54) COMPOSITION FOR CLEANING GASOLINE ENGINE FUEL DELIVERY SYSTEMS, AIR INTAKE SYSTEMS, AND COMBUSTION CHAMBERS

(71) Applicant: THE LUBRIZOL CORPORATION, Wickliffe, OH (US)

(72) Inventors: Stuart L. Bartley, Wickliffe, OH (US); Thomas R. Weyenberg, Wickliffe, OH (US); Michael D. Nicholls, Wickliffe, OH (US); Garrett Parker, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 72 days.

(21) Appl. No.: 15/543,732

(22) PCT Filed: Jan. 15, 2016

(86) PCT No.: PCT/US2016/013644

§ 371 (c)(1),
(2) Date: Jul. 14, 2017

(87) PCT Pub. No.: WO2016/122911

PCT Pub. Date: Aug. 4, 2016

(65) Prior Publication Data

US 2018/0002645 A1 Jan. 4, 2018

Related U.S. Application Data

(60) Provisional application No. 62/109,746, filed on Jan. 30, 2015.

(51) Int. Cl.
*C11D 7/24* (2006.01)
*C11D 7/26* (2006.01)
(Continued)

(52) U.S. Cl.
CPC ..... *C11D 11/0041* (2013.01); *B08B 9/00* (2013.01); *C11D 1/44* (2013.01); *C11D 1/72* (2013.01);
(Continued)

(58) Field of Classification Search
CPC ..... C11D 3/2003; C11D 3/201; C11D 3/2041; C11D 3/2065; C11D 3/2068; C11D 3/43;
(Continued)

(56) References Cited

U.S. PATENT DOCUMENTS 2,952,637 A * 9/1960 Bray ..... C10L 10/06 510/185
3,172,892 A 3/1965 Le Suer et al.
(Continued)

FOREIGN PATENT DOCUMENTS

EP 0310875 A1 4/1998
EP 1843091 B1 3/2006
(Continued)

OTHER PUBLICATIONS

Hansen, "The Three Dimensional Solubility Parameter—Key to Paint Component Affinities," J. Paint Technol., vol. 39, No. 505, pp. 1-103 (Feb. 1967).
(Continued)

*Primary Examiner* — Gregory R Delcotto
(74) *Attorney, Agent, or Firm* — Ann Skerry; Fay Sharpe LLP

(57) ABSTRACT

A cleaning composition, which is suitable for cleaning fuel delivery systems, air-intake systems, intake valves, and combustion chambers, includes at least 3 wt. % of a polyether component, at least 5 wt. % of a polar solvent, and at least 5 wt. % a non-polar solvent. The polyether component is selected from polyethers, polyetheramines, and mixtures thereof.

25 Claims, 1 Drawing Sheet

(51) Int. Cl.

| | |
|---|---|
| ***C11D 7/50*** | (2006.01) |
| ***C11D 11/00*** | (2006.01) |
| ***C11D 1/44*** | (2006.01) |
| ***C11D 3/37*** | (2006.01) |
| ***C11D 3/43*** | (2006.01) |
| ***C11D 7/32*** | (2006.01) |
| ***C11D 1/72*** | (2006.01) |
| ***C11D 3/20*** | (2006.01) |
| ***C11D 3/50*** | (2006.01) |
| ***C11D 3/30*** | (2006.01) |
| ***B08B 9/00*** | (2006.01) |
| ***F02B 77/04*** | (2006.01) |

(52) U.S. Cl.

CPC ..... *C11D 3/201* (2013.01); *C11D 3/2003* (2013.01); *C11D 3/2041* (2013.01); *C11D 3/2065* (2013.01); *C11D 3/2068* (2013.01); *C11D 3/30* (2013.01); *C11D 3/3707* (2013.01); *C11D 3/3723* (2013.01); *C11D 3/43* (2013.01); *C11D 3/50* (2013.01); *C11D 7/263* (2013.01); *C11D 7/3209* (2013.01); *C11D 7/5013* (2013.01); *C11D 7/5022* (2013.01); *C11D 7/5027* (2013.01); *F02B 77/04* (2013.01); *C11D 7/247* (2013.01); *C11D 7/261* (2013.01); *C11D 7/3281* (2013.01)

(58) Field of Classification Search

CPC ..... C11D 3/30; C11D 3/3723; C11D 7/261; C11D 7/263; C11D 7/3209; C11D 7/50; B08B 3/08

USPC ..... 510/183, 184, 185, 187, 238, 245, 254, 510/264, 499, 505, 506; 134/22.19, 39

See application file for complete search history.

(56) References Cited

U.S. PATENT DOCUMENTS

| | | | | |
|---|---|---|---|---|
| 3,381,022 | A | 4/1968 | Le | |
| 3,634,515 | A | 1/1972 | Karll et al. | |
| 4,234,435 | A | 11/1980 | Meinhardt et al. | |
| 5,080,686 | A | 1/1992 | Garrecht et al. | |
| 5,094,667 | A | 3/1992 | Shilowitz et al. | |
| 5,097,806 | A | 3/1992 | Vataru et al. | |
| 5,161,336 | A | 11/1992 | Ritt et al. | |
| 5,257,604 | A | 11/1993 | Vataru | |
| 5,814,594 | A | 9/1998 | Vlasblom | |
| 5,826,636 | A | 10/1998 | Trigiani et al. | |
| 5,970,994 | A | 10/1999 | Sasaki et al. | |
| 5,972,874 | A | 10/1999 | Libutti et al. | |
| 6,000,413 | A | 12/1999 | Chen | |
| 6,073,638 | A | 6/2000 | Sasaki et al. | |
| 6,130,195 | A * | 10/2000 | Doyel | C11D 3/2068 510/174 |
| 6,528,478 | B2 * | 3/2003 | Totoki | C11D 1/75 510/235 |
| 6,616,776 | B1 | 9/2003 | Ahmadi et al. | |
| 6,655,392 | B2 | 12/2003 | Erwin et al. | |
| 6,830,630 | B2 | 12/2004 | Garzke et al. | |
| 6,978,753 | B2 | 12/2005 | Augustus et al. | |
| 7,674,341 | B2 | 3/2010 | Stansilaw et al. | |
| 8,591,666 | B2 | 11/2013 | Spruegel et al. | |
| 8,926,763 | B2 | 1/2015 | Ogasawara et al. | |
| 2002/0023383 | A1 | 2/2002 | Nelson et al. | |
| 2002/0107161 | A1 * | 8/2002 | Gatzke | C11D 3/18 510/185 |
| 2003/0084924 | A1 | 5/2003 | Erwin et al. | |
| 2003/0178000 | A1 | 9/2003 | Augustus et al. | |
| 2004/0121927 | A1 * | 6/2004 | McDonald | C11D 7/26 510/245 |
| 2005/0229952 | A1 | 10/2005 | Erwin | |
| 2006/0128589 | A1 | 6/2006 | Shriner | |
| 2006/0272597 | A1 | 12/2006 | Burrington et al. | |
| 2007/0012342 | A1 | 1/2007 | Stansilaw et al. | |
| 2008/0010774 | A1 | 1/2008 | Erwin et al. | |
| 2008/0011327 | A1 | 1/2008 | Shriner et al. | |
| 2008/0149137 | A1 * | 6/2008 | Steinbrenner | C08J 9/40 134/8 |
| 2008/0283626 | A1 | 11/2008 | Aldana et al. | |
| 2009/0025283 | A1 | 1/2009 | Garrett et al. | |
| 2010/0107484 | A1 | 5/2010 | Vilardo | |
| 2010/0181029 | A1 | 7/2010 | Miller | |
| 2011/0232668 | A1 * | 9/2011 | Hoffmann | A61K 8/39 132/208 |
| 2012/0125445 | A1 | 5/2012 | Simpson-Green et al. | |
| 2012/0138004 | A1 | 6/2012 | Stevenson et al. | |
| 2012/0272667 | A1 | 11/2012 | Ferraro et al. | |
| 2012/0318225 | A1 | 12/2012 | Stevenson et al. | |
| 2013/0017986 | A1 * | 1/2013 | Dabela | B41N 3/00 510/170 |
| 2013/0220379 | A1 | 8/2013 | Sprügel et al. | |
| 2013/0239468 | A1 | 9/2013 | Greenfield et al. | |
| 2014/0261555 | A1 | 9/2014 | Hischier et al. | |
| 2014/0331954 | A1 | 11/2014 | Shriner | |
| 2014/0352711 | A1 * | 12/2014 | Hoffmann | A61K 8/44 132/202 |
| 2015/0290686 | A1 * | 10/2015 | Basu | C11D 7/5018 134/31 |

FOREIGN PATENT DOCUMENTS

| | | |
|---|---|---|
| WO | WO 1992/003641 A1 | 3/1992 |
| WO | WO 2000/041905 | 7/2000 |
| WO | WO 2002/046350 A1 | 6/2002 |
| WO | WO 2002/055640 A1 | 7/2002 |
| WO | WO 2007/140858 | 12/2007 |
| WO | WO 2013/030306 A1 | 3/2013 |

OTHER PUBLICATIONS

Hansen, et al., "Hansen Solubility Parameters, A User's Guide" Second edition, CRC Press, pp. 27-43 (2007).

Soojin Lee, et al., "Simultaneous Determination of Alkoxyalcohols in Wet Wipes Using Static Headspace Gas Chromatography and Mass Spectrometry," Bulletin of the Korean Chemical Society, vol. 35, No. 11, Nov. 20, 2014 (Nov. 20, 2014), pp. 3280-3288, XP055571134, KR ISSN: 0253-2964, DOI: 10.5012/bkcs.2014.35.11.3280.

* cited by examiner

COMPOSITION FOR CLEANING GASOLINE ENGINE FUEL DELIVERY SYSTEMS, AIR INTAKE SYSTEMS, AND COMBUSTION CHAMBERS

This application claims the benefit of PCT Application No. PCT/US2016/013644, filed Jan. 15, 2016 and U.S. Provisional Application No. 62/109,746, filed Jan. 30, 2015, from which the PCT application claims priority, the disclosures of which are incorporated herein by reference in their entireties.

BACKGROUND

The exemplary embodiment relates to a cleaning composition and to a method of cleaning with the composition. The composition and method are effective in removing carbonaceous deposits, in particular, in the fuel delivery system, air intake system, and combustion chamber of an internal combustion engine.

Buildup of deposits in the fuel delivery system of an internal combustion engine can have negative effects on engine operation including reduction in fuel economy, power and drivability. In gasoline engines, it is common for deposits to form on fuel injectors, air intake valves, piston tops, and cylinder heads. One way to remove the deposits is by adding a fuel additive composition to the fuel tank. The fuel additive may be added to the fuel before it is delivered to the tank or as an additive mixture which is added separately to the tank. In either case, the fuel additive is delivered by the fuel to the engine. U.S. Pub. Nos. 20090025283 and 20120318225, for example, describe fuel additives designed for deposit removal and control. Such compositions can be effective, but often work slowly. Thus, if significant deposits have already built up, they may take some time to achieve results.

The deposits can also be removed with a fuel system cleaner solution which is added directly to the fuel delivery system, i.e., downstream of the fuel tank. In this method, a predetermined dose of the cleaning solution is delivered from a canister. The canister is attached to the fuel rail, replacing the normal fuel feed to the engine, and pressurized with air, allowing the solution to travel through the fuel rail to the engine while the vehicle is idling. The process takes about 1 hour to complete. U.S. Pub. Nos. 20020107161, 20050229952, 20060128589, and 20080011327, and U.S. Pat. Nos. 5,161,336, 5,257,604, 6,000,413, 6,655,392, 6,830,630, 6,978,753, and 8,926,763 describe compositions and systems for air intake valve and combustion chamber cleaning by direct delivery methods.

The combustion deposits can also be removed with an air-intake cleaner solution which is added via aerosol or mist or fog or similar through the air-intake system. This application method is most effective in direct injection engines to remove intake valve deposits. Air-intake cleaners can also be applied in port fuel injected engines but intake valve deposits do not need to be addressed in this engine type.

A problem with this approach is that existing rail cleaner products and air-intake cleaners are not highly effective in removing deposits. Since the method is not easily performed without specialized equipment, it is generally performed at a service garage. Thus, efficient cleaning within a short period of time is desirable.

BRIEF DESCRIPTION

In accordance with one aspect of the exemplary embodiment, a composition that is suitable for cleaning fuel delivery systems, intake valves, and combustion chambers includes at least 3 wt. % of a polyether component, at least 5 wt. % of a polar solvent, and at least 5 wt. % a non-polar solvent. The polyether component is selected from the group consisting of polyethers, polyetheramines, and mixtures thereof.

DETAILED DESCRIPTION

Figure 3:
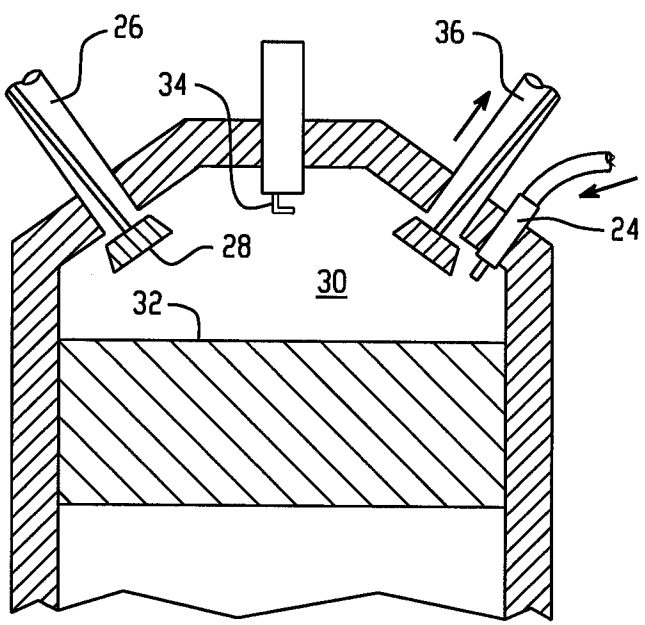
FIG. 3 illustrates a direct injection system employing a rail and/or an air-intake system cleaning composition.

In one aspect of the exemplary embodiment, a single-phase composition for cleaning a fuel system is provided. The composition is effective for removing deposits from fuel delivery and/or air intake systems, including fuel injectors, air intake valves, piston tops and cylinder heads, spark plugs, and all other surfaces in contact with the cleaning composition. The composition can be introduced directly to the fuel system of an internal combustion engine, into the air intake port, directly to the engine, or via a combination of delivery routes, either at the same time or in sequence. In comparative testing, exemplary formulations showed improved performance over existing products for removing deposits generated during the combustion process. The same cleaning composition can be used for each of the different delivery routes or a cleaning composition may be tailored to a specific delivery route.

As used herein, air intake cleaning refers to delivery of a cleaning composition via the air intake port only, and is particularly suited to direct injection engines. "Air intake cleaning compositions" thus clean the valves and combustion chamber as they pass from the air intake port through the engine. As used herein, rail cleaning refers to cleaning via the fuel injection port. As with the air intake cleaning compositions, rail cleaning compositions clean the valves and combustion chamber as they pass from the fuel injection port into the air intake port and through the engine.

The cleaning composition includes a polyether component, which consists of at least one of a polyether and a polyetheramine. The cleaning composition also includes a polar solvent and a non-polar solvent. The composition may further include at least one of a functional solvent, a detergent/dispersant, a corrosion inhibitor, and an aerosol propellant.

The polar solvent and non-polar solvent are referred to collectively as the flammable solvents. By "flammable," it is meant that the solvent is capable of being ignited within the combustion chamber under normal engine operating conditions. For example, the mixture of flammable solvents has a flash point of up to 40° C., such as up to 30° C. While the flammable solvents provide the fuel properties, they also serve to stabilize the remainder of the components in the composition and may themselves provide cleaning properties.

A ratio, by weight, of the polyether component to the total flammable solvents in the composition may be at least 1:12, such as at least 1:10, or at least 1:8, or at least 1:6. The ratio may be up to 1:1.5, or up to 1:2, or up to 1:3, or up to 1:4.

Unexpectedly, the cleaning composition, in its undiluted form (i.e., without added fuel, such as gasoline) is able to maintain combustion while including high concentrations of polyether component and optionally other additives, which together may be present at up to 65 wt. %, or up to 60 wt. %, or up to 50 wt. %, or up to 40 wt. % of the composition, and in some embodiments, at least 20 wt. %, or at least 25 wt. %, or at least 30 wt. %, or at least 35 wt. % of the composition.

Flammable Solvents

The flammable solvents may together account for up to 90 wt. %, or up to 80 wt. %, or up to 75 wt. %, or up to 70 wt. %, or up to 60 wt. %, or up to 55 wt. %, or up to 50 wt. % of the composition, and in some embodiments, at least 30 wt. %, or at least 35 wt. %, or at least 40 wt. %, or at least 45 wt. % of the composition. A ratio, by weight, of the polar solvent to the non-polar solvent in the composition may be at least 1:5, such as at least 1:4, or at least 1:3, or at least 1:2. The ratio may be up to 5:1, or up to 4:1, or up to 3:1, or up to 2:1. In some embodiments, the ratio is about 1:1.

The polar solvent is selected from aliphatic polar solvents, aromatic polar solvents, and mixtures thereof.

In one embodiment, the polar solvent comprises or consists of an aliphatic polar solvent or solvents. Suitable aliphatic polar solvents useful as the polar solvent include or consist essentially of aliphatic polar protic solvents, such as alcohols and amines, and aliphatic polar aprotic solvents, such as ethers.

Exemplary alcohols and amines suitable as aliphatic polar solvents include $C_1$-$C_{12}$ aliphatic chains, such as $C_1$-$C_8$ or $C_2$-$C_4$ aliphatic alcohols or amines. Examples include ethanol, 2-propanol, 1-propanol, 1-butanol, and mixtures thereof. The carbon chain of the alcohol or amine can be branched or unbranched and the heteroatom (oxygen or nitrogen) can be in the normal, iso, sec, or tertiary position. The amine may be a primary, secondary, or tertiary cyclic or acyclic amine and may include aliphatic and/or aromatic groups. Examples of suitable amines include trimethylamine, di-butylamine, hexamine oleylamine, morpholine, methylmorpholine, pyrrolidine, piperidine, methyl piperidine, and their salts and mixtures thereof.

Exemplary aliphatic ethers include $(C_1$-$C_{12}$ alkyl$)_2O$ ethers and can have cyclic or acyclic or straight-chain or branched substituents or the ether functionality may be contained within a ring structure. Examples of suitable ethers include tetrahydrofuran, dimethyl ether, methyl ethyl ether, diethyl ether, and diisopropyl ether.

In one embodiment, the polar solvent comprises or consists of an aromatic polar solvent or solvents. Suitable aromatic polar solvents useful as the polar solvent include or consist essentially of aromatic polar protic solvents, such as alcohols and amines, and aromatic polar aprotic solvents, such as ethers. Examples of aromatic polar solvents include benzyl alcohol, diphenylamine, phenylenediamine, benzylamine, and mixtures thereof.

In some embodiments, the aliphatic polar solvent may be at least 10 wt. %, or at least 15 wt. %, or at least 20 wt. %, or at least 50 wt. %, or at least 70 wt. %, or at least 80 wt. %, or at least 90 wt. %, or up to 100% of the total polar solvent in the composition.

In total, the polar solvent may be present at up to 60 wt. % of the composition, such as at least 5 wt. %, or at least 10 wt. %, or at least 15 wt. %, or at least 20 wt. %, and in some embodiments, up to 50 wt. %, or up to 40 wt. %, or up to 35 wt. %, or up to 30 wt. %, or up to 27 wt. % of the composition.

A ratio of alcohol polar solvents to amine polar solvents may be from 2:1 to 6:1.

It should be noted that amines with alcohol functionality are discussed below as corrosion inhibitors and thus are not considered as polar solvents.

Exemplary non-polar solvents are selected from aromatic non-polar solvents, aliphatic non-polar solvents, and mixtures thereof.

In one embodiment, the non-polar solvents include or consist essentially of (at least 80 wt. %) aromatic non-polar solvents, in particular, aromatic hydrocarbons, i.e., which consist solely of carbon and hydrogen. Exemplary non-polar aromatic hydrocarbons useful as non-polar solvents herein include monocyclic aromatic hydrocarbons, such as $C_1$-$C_4$ alkyl substituted benzenes, e.g., toluene, xylene (one or more of 1,2-, 1,3-, and 1,4-isomers of dimethylbenzene), trimethylbenzene (one or more of 1,2,3-, 1,2,4-, and 1,3,5-isomers of trimethylbenzene), ethylbenzene, and mixtures thereof. Suitable mixtures of $C_8$-$C_{11}$ aromatic solvents include aromatic petroleum distillates, such as Aromatic 100™ ($C_8$-$C_{10}$, mainly $C_9$, predominantly isomers of trimethyl benzene (less than 5% xylene)) and Aromatic 150™ ($C_9$-$C_{11}$, mainly $C_{10}$), available from Exxon Mobil Chemical Co., New Milford, Conn.

Others include aromatic petroleum naphtha and aromatic containing petroleum distillates.

In one embodiment, the non-polar solvent includes one or more aliphatic (including cycloaliphatic) non-polar solvents. Examples include $C_5$-$C_{18}$ straight chain, branched, and cyclic hydrocarbons, such as pentane, cyclopentane, hexane, cyclohexane, heptane, octane, and isooctane, as well as higher carbon-containing hydro-treated distillates. Others include the aliphatic components of petroleum naphtha.

In some embodiments, the aromatic non-polar solvent may be at least 10 wt. %, or at least 15 wt. %, or at least 20 wt. %, or at least 50 wt. %, or at least 70 wt. %, or at least 80 wt. %, or at least 90 wt. %, or up to 100% of the total non-polar solvent in the composition.

In total, the non-polar solvent may be present at up to 65 wt. % percent of the composition, such as at least 5 wt. %, or at least 10 wt. %, or at least 15 wt. %, or at least 20 wt. %, and in some embodiments, up to 50 wt. %, or up to 45 wt. %, or up to 40 wt. %, or up to 35 wt. %, or up to 30 wt. %, or up to 27 wt. %. In total, the polyether component, polar solvent, and non-polar solvent may be at least 60 wt. %, or at least 70 wt. %, or at least 75 wt. %, or up to 95 wt. %, or up to 90 wt. %, or up to 85 wt. % of the composition.

The polar solvent component and non-polar solvent component of the composition may also be defined in terms of their solubility or polarity. A summary of the Hansen solubility component method is reported in Hansen, "The Three Dimensional Solubility Parameter-Key to Paint Component Affinities," J. Paint Technol., Vol. 39, No. 505 (February 1967), hereinafter, "Hansen," and may be calculated using the method reported in Hoy, "Tables of Solubility Parameters," Union Carbide Corporation, Chemical and Plastics R&D Dept, Tarrytown, N.Y. (May 16, 1975); See also, Barton, Handbook of Solubility Parameters, CRC Press (1983).

For the polar solvent, the Hansen solubility parameter $\delta_p$ (which is a measure of the energy from dipolar intermolecular force between molecules) may be at least 2.8 $MPa^{1/2}$, or at least 3, or at least 4, or at least 5, or at least 6 $MPa^{1/2}$, and can be up to 13 $MPa^{1/2}$, or up to 12 $MPa^{1/2}$.

For the non-polar solvent, the Hansen solubility parameter $\delta_p$ may be from 0 up to 3, or up to 2, or up to 1.5, or up to 1.4, or up to 1.2, or up to 1.0 $MPa^{1/2}$.

Polyether Component

The exemplary polyether component is a compound having two or more ether groups and optionally at least one amino group, which can be a primary, secondary or tertiary amino group.

In one embodiment, the polyether and/or polyetheramine is represented by the formula $R[OCH_2CH(R^1)]_nA$, where R is a hydrocarbyl group, $R^1$ is hydrogen or a hydrocarbyl group, A is a nitrogen-containing group, in the case of a polyetheramine, or A is a hydroxyl group (OH), in the case of a polyether, and n is a number which is at least 2.

R can be a hydrocarbyl group having at least 1, or at least 3, or at least 6, or at least 8 carbon atoms and may be up to 30 carbon atoms, or up to 24 carbon atoms, or up to 20 carbon atoms. R can be derived from an alcohol, an alkylphenol, or a mixture thereof where the mixture can be a mixture of 2 or more alcohols, 2 or more alkylphenols, or 1 or more alcohols and 1 or more alkylphenols. The alcohol can be linear, branched, or a mixture thereof.

$R^1$ may be hydrogen or hydrocarbyl group, such as an alkyl group, of 1 to 16, or up to 14, or up to 8 carbon atoms, e.g., selected from methyl, ethyl, and mixtures thereof. In one embodiment, the alkylene oxide has from 2 to 18 carbon atoms, such as 2 (ethylene), 3 (propylene) or 4 (butylene) carbon atoms, or a mixture thereof. In some embodiments, a small portion, e.g., less than 30% (by number), or less than 20%, or less than 10% of the alkylene oxide groups are ethylene oxide (i.e., $R^1$=H). In other embodiments, no more than 2%, or no more than 1% of the alkylene oxide groups are ethylene oxide.

The number n of alkylene oxide groups in the polyetheramine/polyether formula can be at least 10, or at least 16, or at least 18 and may be up to 50, or up to 38, or up to 28, or up to 26, or up to 24.

A in the polyetheramine formula may be selected from amines, ether amines and mixtures thereof. Suitable amines and ether amines include those of the formulas $—OCH_2CH_2CH_2NR^2R^2$ and $—NR^3R^3$, where each $R^2$ is independently hydrogen or a hydrocarbyl group of one or more carbon atoms, and each $R^3$ is independently hydrogen, a hydrocarbyl group of one or more carbon atoms, or $—[R^4(R^5)]_pR^6$, where $R^4$ is a $C_2$-$C_{10}$ alkylene, $R^5$ and $R^6$ are independently hydrogen or a hydrocarbyl group of one or more carbon atoms, and p is a number from 1 to 7.

The polyetheramine may be derived from a polyether intermediate of the general form $RO[CH_2CH(R^1)O]_nH$ where R, $R^1$ and n are as described above. The polyether intermediate can be formed by condensing an alcohol and/or alkylphenol with one or more alkylene oxides in a base catalyzed reaction as described, for example, in U.S. Pat. No. 5,094,667. A ratio of alcohol and/or alkylphenol to alkylene oxide may be from 1:2 to 1:50, and in some embodiments, can be at least 1:10, or at least 1:16, or at least 1:18, or up to 1:38, or up to 1:28, or up to 1:26.

The polyether intermediate can be converted to a polyetheramine where A is $—NR^3R^3$, as described above, by a direct amination reaction of the polyether intermediate with an amine, ammonia, or a polyamine as described, for example, in EP 0310875, The polyether intermediate can be converted to a polyetheramine where A is $—OCH_2CH_2CH_2NR^2R^2$ by reaction with acrylonitrile followed by hydrogenation, as described, for example, in U.S. Pat. No. 5,094,667. In one embodiment, the polyether intermediate can be converted to a polyetheramine where A is $—OCH_2CH_2CH_2NH_2$ by reacting the polyether intermediate with acrylonitrile to form a cyanoethylated intermediate which can then be hydrogenated to form the polyetheramine.

Suitable polyetheramines include those where A is $—OCH_2CH_2CH_2NH_2$.

The polyetheramine and/or polyether may have a number average molecular weight of at least 300 or at least 350, or at least 400, or at least 450, or at least 1000, and in some embodiments, the number average molecular weight may be up to 5000, or up to 3500, or up to 2500, or up to 2000. Polyetheramines are commercially available in the Techron™ series from Chevron and in the Jeffamine™ series from Huntsman. A mixture of polyetheramines may be used.

Example polyetheramines/polyethers include butylene oxide-based polyetheramines/polyethers and propylene oxide-based polyetheramines/polyethers where n is 20-24 and R is a $C_8$-$C_{20}$ chain.

The polyetheramine may function as a deposit control additive in some embodiments.

The polyether component may be present in the composition at a concentration of at least 3 wt. %, such as at least 4 wt. %, or at least 5 wt. %, or at least 6 wt. %, or at least 8 wt. %, or at least 10 wt. %, or at least 11 wt. %, or at least 15 wt. %, and in some embodiments, may be present at up to 40 wt. %, or up to 27 wt. %, or up to 25 wt. %, or up to 23 wt. %, or up to 21 wt. %.

In some embodiments, at least 20 wt. % or at least 50 wt. %, or at least 70 wt. % or at least 90 wt. % or at least 99 wt. % or 100 wt. % of the polyether component is polyetheramine.

Functional Solvents

One or more functional solvents is/are optionally present in the composition. For purposes of this disclosure, functional solvents do not class as non-polar or polar solvents, as described above, and vice versa. Suitable functional solvents include glycols, ketones, amides, cyclic amides, esters or acetates, and those which have a combination of functionalities.

Exemplary glycols include diethylene glycol dialkyl ethers, dipropylene glycol, butyl glycol (also known as butyl cellosolve), 2-methyl-2,4-pentanediol, ethylene glycol, propylene glycol, and mixtures thereof.

Exemplary ketones include methyl ethyl ketone, acetone, cyclohexanone, and mixtures thereof. In some embodiments, the composition includes at least 1 wt. %, or at least 2 wt. % of ketone(s), and in some embodiments, up to 10 wt. %, or up to 5 wt. % of ketone(s).

Exemplary amides include primary, secondary, and tertiary amides and cyclic amides, including lactams, such as pyrrolidones. Exemplary amides include N,N-dimethylformamide and N,N-dimethylacetamide, and mixtures thereof. Exemplary pyrrolidones include 2-pyrrolidone, 1-methyl-2-pyrrolidone, and 1-ethyl-2-pyrrolidone, 1-ethenyl-2-pyrrolidinone, 1-propyl-2-pyrrolidinone, and 1-cyclohexyl-2-pyrrolidone, and mixtures thereof. In some embodiments, the composition includes at least 1 wt. %, or at least 2 wt. % of cyclic amide(s), and in some embodiments, up to 10 wt. %, or up to 5 wt. % of amide(s).

Exemplary esters and acetates include alkyl acetates, e.g., $C_3$-$C_8$ alkyl acetates, such as ethyl acetate and n-propyl acetate. In some embodiments, the composition includes at least 1 wt. %, or at least 2 wt. %, or at least 5 wt. % of esters or acetate(s), and in some embodiments, up to 20 wt. %, or up to 15 wt. % of esters or acetate(s).

Other exemplary functional solvents include those which have both ether and alcohol functionality on the same molecule and which may have a molecular weight of up to 200. Examples include alkoxyalcohols, such as butyl cellosolve (2-butoxy ethanol) and ethoxypropanol. In some embodiments, the composition includes at least 1 wt. %, or at least 2 wt. %, or at least 5 wt. %, or at least 10 wt. % of alkoxyalcohol(s), and in some embodiments, up to 20 wt. %, or up to 17 wt. %, or up to 15 wt. % of alkoxyalcohol(s).

Mixtures of such functional solvents may be used.

Where used, the functional solvents may be present in the composition at a total concentration between 1 and 40 wt. % percent, such as at least 2 wt. %, or at least 3 wt. %, or at least 5 wt. %, or at least 8 wt. %, or at least 10 wt. %, and can be up to 30 wt. %, or up to 25 wt. %, or up to 20 wt. %, or up to 15 wt. %. The functional solvent has a solubility of at least 10 parts by weight of functional solvent in both of the flammable solvents.

Water

In some embodiments water is present in the composition. Where used, the water may be present at a concentration which is low enough that the water does not form a separate layer, such that the cleaning composition is a single phase at room temperature (15-20° C.), and in some, remains a single phase at temperatures as low as 0° C. Water that is in azeotropic combination with an alcohol or other constituent shall be deemed to be part of the aqueous content of the composition. As an example, water may be present at up to 10 wt. %, or up to 5 wt. %, or up to 4 wt. %, or up to 3.5 wt. %, and in some embodiments, may be at least 0.5 wt. %, or at least 1 wt. %, or at least 1.5 wt. %, or at least 2 wt. % of the composition.

The water may evaporate in the engine, providing a steam cleaning effect and may also serve as a polar solvent.

Detergents/Dispersants

One or more detergents/dispersants is optionally present in the composition. Exemplary detergent/dispersants include amphiphilic substances which possess at least one hydrophobic hydrocarbon moiety with a number-average molecular weight of 100 to 10000 and at least one polar moiety. The polar moiety may be selected from (i) monoamino and polyamino groups having up to 6 nitrogen atoms, at least one nitrogen atom having basic properties; (ii) hydroxyl groups in combination with mono or polyamino groups where at least one of the nitrogen atoms has basic properties; (iii) carboxylic acid groups or their alkali metal or alkaline earth metal salts; (iv) sulfonic acid groups or their alkali metal or alkaline earth metal salts; (v) polyoxy-$C_2$ to $C_4$ alkylene moieties terminated by hydroxyl groups, mono- or polyamino groups where at least one nitrogen atom has basic properties, or by carbamate groups; (vi) carboxylic ester groups; (vii) moieties derived from cyclic anhydrides, for example succinic anhydride and having hydroxyl and/or amino and/or amido and/or imido groups; and/or (viii) moieties obtained by Mannich reaction of substituted phenols with aldehydes and mono- or polyamines.

The hydrophobic hydrocarbon moiety in the exemplary detergent/dispersant additive helps to ensure the adequate solubility of the detergent/dispersant in the composition. Example hydrocarbon moieties have a number-average molecular weight (Mn) of 85 to 20,000, such as at least 100, or at least 300, or at least 500 or at least 700 or at least 800, and in some embodiments, up to 10,000, or up to 5000, or up to 3000, or up to 2500, or up to 1500. Example hydrophobic hydrocarbon moieties include polypropenyl, polybutenyl and polyisobutenyl moieties with a number-average molecular weight of at least 300, or at least 500, or at least 700, or at least 800, and in some embodiments, up to 5000, or up to 3000, or up to 2500, or up to 1500.

Example high total base number (TBN) nitrogen containing detergent/dispersants useful herein include succinimides (the condensation product of a hydrocarbyl-substituted succinic anhydride with a poly(alkyleneamine)). Succinimide detergents/dispersants are more fully described in U.S. Pat. Nos. 4,234,435 and 3,172,892.

Another class of ashless dispersant useful herein is high molecular weight esters, prepared by reaction of a hydrocarbyl acylating agent and a polyhydric aliphatic alcohol such as glycerol, pentaerythritol, or sorbitol. Such materials are described in U.S. Pat. No. 3,381,022.

Example nitrogen-containing detergents are the reaction products of a carboxylic acid-derived acylating agent and an amine. The acylating agent can be selected from formic acid and its acylating derivatives and acylating agents having high molecular weight aliphatic substituents of up to 5,000, 10,000 or 20,000 carbon atoms. The amino compounds can be selected ammonia and amines having aliphatic substituents of up to about 30 carbon atoms, and up to 11 nitrogen atoms. One class of acylated amino compounds suitable for use herein includes those formed by the reaction of an acylating agent having a hydrocarbyl substituent of at least 8 carbon atoms and a compound comprising at least one primary or secondary amine group. The acylating agent may be a mono- or polycarboxylic acid (or reactive equivalent thereof), for example a substituted succinic, phthalic or propionic acid, and the amino compound may be a polyamine or a mixture of polyamines, for example a mixture of ethylene polyamines. Alternatively the amine may be a hydroxyalkyl-substituted polyamine. The hydrocarbyl substituent in such acylating agents may comprise at least 10, or at least 12, or at least 30 carbon atoms, and in some embodiments, up to 200, or up to 50 carbon atoms. The hydrocarbyl substituent of the acylating agent may have a number average molecular weight of at least 170, or at least 250, or at least 500, or at least 700, and in some embodiments, up to 2800, or up to 1500, or up to 1300, or up to 1100. In one embodiment, the hydrocarbyl substituent has a number average molecular weight of 700-1000, e.g., 700-850, such as 750. An example nitrogen-containing detergent of this type is derived from the reaction of oleic acid with an ethanolamine derivative, such as diethanolamine or ethanolamine.

Another class of ashless dispersant is Mannich bases. These are materials which are formed by the condensation of a higher molecular weight, alkyl substituted phenol, an alkylene polyamine, and an aldehyde such as formaldehyde and are described in U.S. Pat. No. 3,634,515.

One useful nitrogen-containing dispersant is the product of a Mannich reaction between (a) an aldehyde, (b) an amine or polyamine, and (c) an optionally-substituted phenol. The phenol is substituted such that the Mannich product has a molecular weight of less than 7500, or less than 2000, or less than 1500, or less than 1300, or less than 1200, or less than 1100, or less than 1000, or less than 900, or less than 850, or less than 800. The substituted phenol may be substituted with up to 4 groups on the aromatic ring. For example, it may be a tri or di-substituted phenol. In one embodiment it is a mono-substituted phenol. It may be substituted at the ortho, and/or meta, and/or para position(s). To form the Mannich product, the molar ratio of the aldehyde to amine may be at least 1:1, and may be up to 4:1, or up to 2:1; the molar ratio of the aldehyde to phenol may be at least 0.75:1, or at least 1:1, and may be up to 4:1, or up to 2:1; and the molar ratio of the phenol to amine may be at least 1.5:1, or at least 1.6:1, or at least 1.7:1, or at least 1.8:1, or at least 1.9:1 and may be up to 5:1, or up to 4:1, or up to 3.5:1, or up to 3.25:1, or up to 3:1, or up to 2.5:1, or up to 2.3:1, or up to 2.1:1.

As an example, a polyisobutylene-based Mannich detergent may be formed by reaction of 1000 MW polyisobutylene-phenol reacted with formaldehyde and dimethylamine.

Other suitable dispersants include polymeric dispersant additives, which are generally hydrocarbon-based polymers which contain polar functionality to impart dispersancy characteristics to the polymer. An amine is typically employed in preparing the high TBN nitrogen-containing dispersant. One or more poly(alkyleneamine)s may be used, such as one or more poly(ethyleneamine)s having 3 to 5 ethylene units and 4 to 6 nitrogen units. Such materials include triethylenetetramine (TETA), tetraethylenepentamine (TEPA) and pentaethylenehexamine (PEHA). Such materials are typically commercially available as mixtures of various isomers containing a range number of ethylene units and nitrogen atoms, as well as a variety of isomeric structures, including various cyclic structures. The poly (alkyleneamine) may likewise comprise relatively higher molecular weight amines known in the industry as ethylene amine still bottoms.

Other detergents useful herein include quaternary ammonium salt detergents containing an amide group or an ester group, and where the quaternized detergent is the reaction product of (a) a non-quaternized detergent containing an amide group or an ester group, where the detergent has a tertiary amine functionality, and (b) a quaternizing agent, such as ethylene oxide, propylene oxide, butylene oxide, styrene oxide, or a combination thereof, as described in U.S. Pub. No. 20120138004, and quaternized polyester salts which are the reaction product of (a) a polyester containing a tertiary amino group; and (b) a quaternizing agent suitable for converting the tertiary amino group to a quaternary nitrogen, as described in U.S. Pub. No. 20130239468.

Another useful detergent is made by reacting a linear or branched alkenyl substituted succinic anhydride or diacid with dialkylalkanolamine in a mole ratio of about 1:about (0.4-1.25) respectively, and in one embodiment in an mole ratio of about 1:(0.8-1.2) respectively. As an example, a detergent is made by reacting a hexadecenyl succinic anhydride with N,N-dimethylethanolamine in an equivalent ratio of about 1:about (0.4-0.6) (which also corresponds to a mole ratio of about 1:about (0.8-1.2)) respectively, and in one embodiment in an equivalent ratio of about 1:0.5 (mole ratio of about 1:1) respectively.

Amphiphilic dispersants useful herein include carboxylic acids which include from 10 to 50 carbon atoms, such as from 10 to 25 carbon atoms. The carboxylic acid may be linear or branched. It may be selected from aryl, aliphatic or arylaliphatic acids optionally bearing other functions provided that these functions are stable in the composition. Example carboxylic acids include fatty acids of tallol, soya bean, tallow oil, flax oil, oleic acid, linoleic acid, stearic acid and its isomers, pelargonic acid, capric acid, lauric acid, myristic acid, dodecylbenzenesulfonic acid, ethyl-2-hexanoic acid, naphthenic acid, and hexanoic acid.

When present in the composition, the detergent and/or dispersant may be present at a total concentration of at least 0.5 wt. %, or at least 1 wt. %, or at least 1.5 wt. %, or at least 1.8 wt. %, or at least 2 wt. %, and may be present at up to 55 wt. %, or up to 10 wt. %, or up to 5 wt. %, or up to 4 wt. %, or up to 3 wt. % of the composition.

In some embodiments, the detergent may be premixed with the polyether component. One such mixture includes 8 wt. % polyisobutylene-based Mannich detergent (1000 MW polyisobutylene-phenol reacted with formaldehyde and dimethylamine), 45 wt. % polyetheramine (propylene oxide based), and a solvent (the balance).

Corrosion Inhibitor

One or more corrosion inhibitors is optionally present in the composition.

Corrosion inhibitors useful herein include aminoalcohols, such as isopropanolamine, dimethylethanolamine and triethanolamine; ascorbic acid; succinic acid and alkyl and alkenyl succinic acids and anhydrides (e.g., $C_{10}$ and higher alkenyl or alkyl succinic acids and anhydrides, such as dodecenyl succinic acid and polyisobutylene succinic acid) or other cyclic anhydrides and polymers thereof; cyclopentyl and cyclohexyl carboxylic acids, such as naphthenic acid (a mixture of $C_9$-$C_{20}$ cyclopentyl and cyclohexyl carboxylic acids), and their salts; and mixtures thereof. Example naphthenic acid salts include the products of the reaction of naphthenic acid and oleic acid with polyethyleneamine and ethylene oxide.

Example alkyl and alkenyl succinic acids/anhydrides include dodecenyl succinic acid and those described in U.S. Pat. No. 5,080,686.

Where present, the corrosion inhibitor may be used in an amount of 0.01 to 5 wt. %, or up to 3 wt. % of the composition.

Other Additives

Other additives may be included in the composition, such as foaming agents, rheology modifiers, pH modifiers (such as acids and bases), antimicrobial agents (e.g., fungicides and bactericides), antioxidants, colorants, perfumes, diluents, propellants, combinations thereof, etc.

Fuel Content

In one embodiment, the exemplary composition has little or no iso-octane. For example, the exemplary composition may include no more than 10 wt. % or no more than 5 wt. % of Ca aliphatic hydrocarbons, in particular, iso-octane.

In other embodiments, such components may be present at a concentration of up to 50 wt. %, or up to 30 wt. % of the composition.

As will be appreciated, some of the components of the composition may serve two or more functions in the cleaning composition.

TABLE 1 shows illustrative cleaning compositions.

TABLE 1

Example Compositions

| | Composition 1, wt. % | Composition 2, wt. % | Composition 3 wt. % | Composition 4 wt. % |
|---|---|---|---|---|
| Non-polar (e.g., aromatic) solvent | 10-65 | 15-50 | 20-40 | 20-40 |
| Polar (e.g. aliphatic) solvent | 10-60 | 15-45 | 20-35 | 20-45 |
| Polyether component (e.g., polyetheramine) | 5-27 | 10-25 | 15-23 | 15-27 |
| Functional solvent | 1-40 | 5-30 | 10-30 (including an alkoxy-alcohol) | 8-25 |
| Detergent/dispersant | 0-10 | 1-10 | 1-5 | 0-10 |
| Corrosion Inhibitor | 0-14 | 0.1-6 | 1-5 | 0-5 |
| Water | 0-5 | 0-3 | 0-3 or 0.5-3 | 0-3.5 |
| Other components | Up to 50 | Up to 30 | Up to 20 | Up to 40 |

Composition 3 is particularly suited to use as a fuel rail cleaning composition, while Composition 4 is particularly suited to use as an air intake cleaning composition.

One specific composition suited to rail cleaning includes 20-25 wt. % non-polar aromatic solvent, 20-30 wt. % polar aliphatic solvent (including an alcohol and an amine in a ratio of from 3:1 to 2:1 alcohol:amine), from 16-23 wt. % polyether, from 15-22 wt. % functional solvent, and optionally a corrosion inhibitor and/or a detergent.

One specific composition suited to air intake cleaning includes 15-25 wt. % non-polar aromatic solvent, 20-40 wt. % polar aliphatic solvent (including an alcohol and an amine in a ratio of from 6:1 to 2:1 alcohol:amine), from 12-20 wt. % polyether, from 12-40 wt. % functional solvent, and optionally a corrosion inhibitor and/or a detergent. In another embodiment, the air intake cleaning composition may be free or substantially free of polyether (less than 5 wt. %, or less than 1 wt. %, or 0 wt. % polyether).

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. By predominantly hydrocarbon character, it is meant that at least 70% or at least 80% of the atoms in the substituent are hydrogen or carbon.

Examples of hydrocarbyl groups include:

(i) hydrocarbon substituents, that is, aliphatic (e.g., alkyl, alkenyl, or alkynyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, may contain other than carbon in a ring or chain otherwise composed of carbon atoms.

Representative alkyl groups include n-butyl, iso-butyl, sec-butyl, n-pentyl, amyl, neopentyl, n-hexyl, n-heptyl, secondary heptyl, n-octyl, secondary octyl, 2-ethyl hexyl, n-nonyl, secondary nonyl, undecyl, secondary undecyl, dodecyl, secondary dodecyl, tridecyl, secondary tridecyl, tetradecyl, secondary tetradecyl, hexadecyl, secondary hexadecyl, stearyl, icosyl, docosyl, tetracosyl, 2-butyloctyl, 2-butyldecyl, 2-hexyloctyl, 2-hexydecyl, 2-octyldecyl, 2-hexyldodecyl, 2-octyldodecyl, 2-decyltetradecyl, 2-dodecylhexadecyl, 2-hexyldecyloctyldecyl, 2-tetradecyloctyldecyl, monomethyl branched-isostearyl, and the like.

Representative aryl groups include phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl benzylphenyl, styrenated phenyl, p-cumylphenyl, α-naphthyl, β-naphthyl groups, and mixtures thereof.

Heteroatoms include sulfur, oxygen, nitrogen, and encompass substituents as pyridyl, furyl, thienyl and imidazolyl. In general, no more than two, and in one embodiment, no more than one, non-hydrocarbon substituent will be present for every ten carbon atoms in the hydrocarbyl group. In some embodiments, there are no non-hydrocarbon substituents in the hydrocarbyl group.

Delivery System

The composition may be delivered as an aerosol, mist, fog, foam, spray, pressurized liquid or semi-liquid, or metered droplets by a suitable delivery system. An exemplary delivery system holds a measured dose of the composition, such as from 100-1000 mL, e.g., at least 200, or at least 300, or at least 500 mL, or up to 700 mL, such as about 590 mL (about 20 U.S. fluid ounces) or about 325 mL (about 11 U.S. fluid ounces).

In a port fuel injection engine, the composition may be delivered by applying a pressure to the composition sufficient to cause it to flow to the engine, while the fuel injectors themselves control the rate of delivery to the engine while it is running. In a direct fuel injection engine, the composition may be delivered directly to the engine through the fuel injector. In another embodiment, the composition may be delivered, e.g., in the form of an aerosol, to the air intake port. In either a port injection or a direct injection system, this may be done while fuel is being delivered at the same time from the direct injector. To provide further cleanup, a dual application can be performed where the product is delivered through the air intake port at the same time as it is applied through the fuel injector or alternatingly. In a PFI or GDI engine system, the cleaning composition(s) can also be delivered through a vehicle on-board dosing device through the fuel rail and/or air-intake streams.

Figure 1:
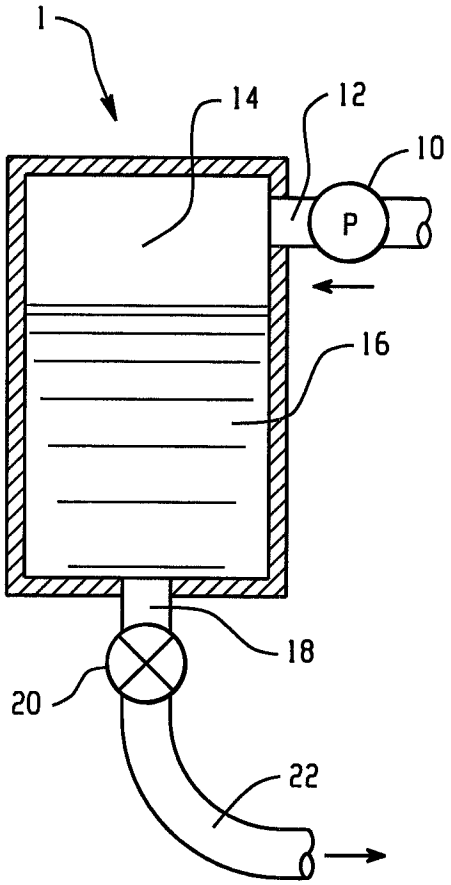
FIG. 1 illustrates an apparatus for delivering a rail cleaning and/or an air-intake composition to a fuel system in accordance with one aspect of the exemplary embodiment.

For example, as shown in FIG. 1 an example delivery system 1 includes a pressure regulator 10 which allows pressurized gas to enter an inlet port 12 of a cylindrical reservoir 14 which holds a predetermined amount of the cleaner composition 16. The cleaner composition exits the reservoir via an outlet port 18 which may be regulated by a valve or pressure regulator 20. A flexible tube 22 connects the outlet port 18 with the engine's fuel delivery and/or air intake system.

Figure 2:
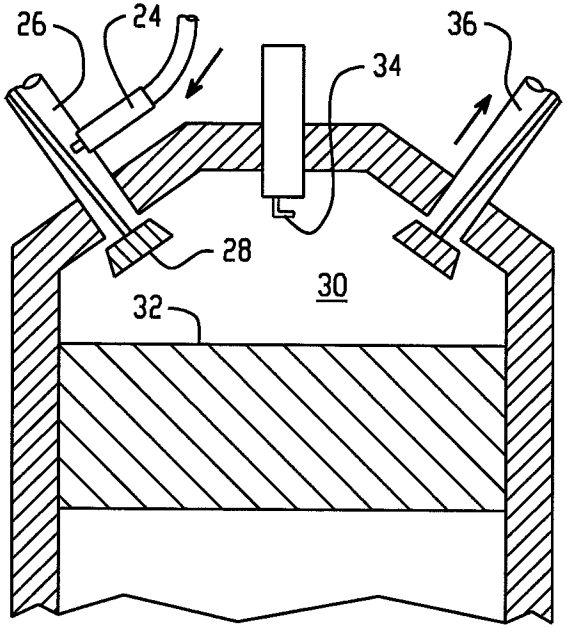
FIG. 2 illustrates a port fuel injection (PFI) system employing a rail and/or an air-intake system cleaning composition.

In one embodiment (FIG. 2), suited to PFI engines, the cleaner composition is delivered via the fuel line to the fuel injectors 24, which regulate the introduction of the cleaner into the respective air intake ports 26 of the air intake system. The cleaning composition flows through the air intake valve 28 and into the combustion chamber 30, where it contacts the piston head 32, and is ignited by the spark plug 34. In direct injection systems, the cleaner composition may be injected directly to the combustion chamber. The exhaust gas exits the combustion chamber via an outlet 36 and, in some embodiments, may be recycled to the inlet 12 by a suitable connecting tube (not shown).

In another embodiment (FIG. 3), suited to direct fuel injection systems, the cleaner composition is delivered via the fuel line to the fuel injectors 24, and thus the cleaner composition is delivered directly into the engine.

In another embodiment (not shown), suited to direct fuel injection systems, but can also be used with port fuel injection systems, the cleaner composition is delivered directly to the air intake port 26, e.g., as an aerosol or mist, which may suitably be delivered from a can, rather than from the apparatus of FIG. 1. The air intake cleaning composition flows through the air intake valve 28 and into the combustion chamber, where it contacts the piston head 32, and is ignited by the spark plug 34 along with the fuel. The exhaust gas exits the combustion chamber via an outlet 36 and, in some embodiments, may be recycled to the inlet 12 by a suitable connecting tube (not shown). In direct injection systems, the cleaner composition may alternatively be injected directly to the combustion chamber through the injector 24 from the apparatus of FIG. 1.

In some embodiments, multiple applications are performed where the cleaner is delivered through the air intake port at the same time as it is applied through the fuel injector. This process can also be performed in sequential order, e.g., by applying the cleaner through the air-intake port followed by application through the fuel port, or vice versa. Different cleaner compositions and/or delivery devices may be employed in this embodiment.

In some embodiments, rather than being introduced under pressure, the composition is introduced by drawing a vacuum on the engine. For example, a vacuum may be applied to a vacuum port, such as the exhaust port of the engine chamber. The composition is drawn in through a tube attached to the air intake pipe or fuel injector to draw the composition through the engine chamber. The vacuum on the vacuum port may provide a vacuum of at least 16 inches of Hg, or at least 18 to 22 inches of Hg.

In other embodiments, the engine cleaner composition is provided in a pressure-resistant container under the pressure of a propellant. The propellant used in this embodiment should be compatible with the components of the composition. The propellant may be oxygen free or substantially free of oxygen (less than 100 ppm oxygen). The propellant may be chemically/oxidatively inert. Suitable aerosol propellants provide a relatively constant can pressure as the engine cleaner composition is expelled. Propellants suitable for use in aerosol formulations herein include, for example, compressed gases, such as nitrogen, carbon dioxide, air, and nitrous oxide; liquid hydrocarbon propellants, such as $C_3$-$C_8$ hydrocarbons, e.g., propane, 1-butane, 2-butane, and dimethyl ether; chlorofluorocarbons (CFCs) hydrofluorocarbons (HFCs) and hydrochlorofluorocarbons (HCFCs), such as CFC-11, HCFC-22, HCFC-142b, HCFC-152a, HFC-125, HFC-227 and hydrofluoroalkanes (HFA), such as 1,1-difluoroethane, HFA 134a (1,1,1,2-tetrafluorethane) and HFA 227 (1,1,1,2,3,3,3-heptafluoropropane); ethers, such as dimethyl ether (DME) and methylethyl ether, fluorinated dimethyl ethers, such as bis(difluoromethyl)ether; SF6, vinyl chloride monomer, and mixtures thereof. In one embodiment the propellant is free of halogens, since these may form acids during combustion. Combinations of propellants may be used. The aerosol can pressure may range from about 130 kPa to about 240 kPa.

In one embodiment, a foaming aerosol product is introduced into the intake manifold while the engine is running, and contacts the valves directly where the foam breaks, wetting the metal parts and deposits, cleaning the deposit build up from the ports and valves. The cleaning agents, along with the dissolved deposits, are carried inside the combustion chamber with the incoming air flow and burned within the combustion chamber. A convenient aerosol delivery system includes an extended hose and nozzle tip for easy insertion into the intake manifold.

Exemplary delivery systems which may be used herein are described, for example, in U.S. Pub Nos. U.S. Pub. Nos. 20020107161, 20050229952, 20060128589, 20080011327, and U.S. Pat. Nos. 5,161,336, 5,257,604, 6,000,413, 6,655,392, 6,830,630, 6,978,753, and 8,926,763.

In some embodiments the delivery of the composition may be preceded by and/or followed by or in conjunction with the addition of a fuel cleaner additive composition to the fuel tank, which enters the engine mixed with the fuel in the tank. The mixture of fuel and fuel additive composition thus contains additives at low concentrations, typically, at a total additive concentration of up to 10% of the additives (excluding the flammable solvents) used in the present composition, which is introduced in substantially neat form to the engine.

Example fuel cleaner compositions suitable for this purpose are described, for example, in U.S. Pub Nos. 20020023383, 20060272597, and 20100107484.

The component(s) of a spark-ignited internal combustion engine to be cleaned by the exemplary cleaning composition include air intake ports, fuel injectors, air intake valves, spark plugs, piston heads, and surfaces of the combustion chamber.

The internal combustion engine may be a diesel fueled engine (such as a heavy duty diesel engine), a gasoline fueled engine, a natural gas fueled engine, a mixed gasoline/alcohol fueled engine, a kerosene fueled engine, a heating oil-fueled engine, or a biodiesel fueled engine. The internal combustion engine may be a 2-stroke or 4-stroke engine. Suitable internal combustion engines include marine diesel engines, aviation piston engines, low-load diesel engines, stationary engines, and automobile and truck engines. In one embodiment the internal combustion engine is a gasoline direct injection (GDI) engine. The composition may also be used to clean stationary engines.

Without intending to limit the scope of the exemplary embodiment the following examples illustrate cleaning compositions and their performance.

EXAMPLES

Candidate compositions are designed to meet or exceed performance of existing fuel system cleaning products. The cleaning compositions all include sufficient flammable solvents (xylene, toluene, isopropanol) to sustain combustion, since the engine operates on the cleaner solution. Other components are selected from detergents, functional solvents, corrosion inhibitors, fuels, other additives, and water.

Unless otherwise specified, the following ingredients are obtained from Lubrizol Corporation, Wickliffe Ohio.

Flammable Solvents

Non-polar (aromatic) solvents: toluene, xylene; petroleum naphtha, obtained from American Refining Group.

Polar (aliphatic) solvents: isopropanol, 2-ethylhexanol, morpholine (obtained from Univar Inc., Downers Grove, Ill.), oleylamine.

Polyethers and Polyetheramines

Butylene oxide-based polyetheramine (BPEA) prepared via cyanoethylation and hydrogenation of polyether from an alcohol mixture containing predominantly $C_{13}$ alcohol having an average of about 18-22 repeating units from butylene oxide.

Propylene oxide based-polyetheramine (PPEA) prepared via cyanoethylation and hydrogenation of polyether from a $C_{12-15}$ alcohol having an average of 24 repeating units from propylene oxide.

Propylene oxide based-polyether (PPE), a polyether prepared from a $C_{12-15}$ alcohol having an average of 24 repeating units from propylene oxide.

Functional Solvents

Butyl cellosolve (2-butoxyethanol), obtained from Technical Products, Inc., Cleveland Ohio.

1-Methyl-2-pyrrolidone, obtained from BASF.

Oleylamine ((Z)-octadec-9-enylamine), obtained from Akzo Nobel.

Water

Distilled.

Detergents

Polylsobutylene (PIB)-based Mannich detergent (1000 MW PIB-phenol reacted with formaldehyde and dimethylamine) (90 wt. %, 10 wt. % petroleum naphtha).

Polyisobutylene-based quaternary amine (74 wt. % amine, 26 wt. % 2-ethylhexanol (which serves as a functional solvent)).

Hexadecenyl succinic anhydride product with N,N-dimethylethanolamine (N,N-DMEA).

Corrosion Inhibitors

Naphthenic acid salt (a mixture formed by reaction of naphthenic acid and oleic acid with polyethyleneamines and ethylene oxide) (65 wt. %, 9 wt. % mineral oil).

Dodecenyl succinic acid (4-[(E)-dodec-1-enoxy]-4-oxobutanoic acid) (61 wt. %, 39 wt. % mineral oil).

Polyisobutylene succinic acid (85 wt. %, 15 wt. % mineral oil).

Triethanolamine, obtained from Univar Inc.

Other Additives

Ammonium hydroxide (26 wt. %, 74 wt. % water), a base, obtained from Univar Inc., Downers Grove, Ill.

Bis-(2 hydroxyethyl) tallowalkyl amine oxide, obtained under the trademark Aromox® T/12 DPM, from Akzo Nobel. (64 wt. %, 36 wt. % of a dipropylene glycol, methyl ether and water solution. Aromox® T/12 DPM also functions as an acid degreaser, foam booster, and rheology modifier.

Example compositions (exclusive of any propellants) are shown in Table 2, where all weight percentages are expressed on an actives basis (shown in brackets if the component is not neat).

TABLE 2

Fuel System Rail and Air Intake Cleaner Formulations

| Function | Ingredient | Ex. 1 | Ex. 2 | Ex. 3 | Ex. 4 | Ex. 5 |
|---|---|---|---|---|---|---|
| Non-polar (aromatic) solvent | toluene | 50 | 51 | 38 | 47.7 | 42 |
| | xylene | | | | | |
| | Petroleum naphtha | | | | 0.2 | |
| Non-polar (aliphatic) solvent | Mineral oil | 0.45 | 0.79 | | 0.78 | 3.78 |
| Polar (aliphatic) solvent | isopropanol | 37 | 31 | 32 | 25 | 30 |
| | 2-ethylhexanol | 0.78 | | | | |
| | morpholine | | | 5 | | |
| | oleylamine | | | | | |
| Water | distilled water | 3 | 2.1 | | | |
| Polyether component | BPEA | 4 | | 15 | | |
| | PPEA | | 12 | | 11.3 | |
| | PPE | | | | | 7 |
| Functional solvent | butyl cellosolve | | | 10 | | |
| | n-methyl-2-pyrrolidone | | | | | |
| | n-propyl acetate | | | | 10 | |
| Detergent | PIB-based Mannich detergent | | 2.1 (1.89) | | 2.04 (1.84) | |
| | PIB-based quaternary amine | 3 (2.22) | | | | |
| Corrosion Inhibitor | naphthenic acid salt | | | | | |
| | triethanolamine | | | | | |
| | dodecenyl succinic acid | | 2.06 (1.27) | | 2 (1.22) | 7 (4.27) |
| | PIB succinic acid | 3 (2.55) | | | | 7 (5.95) |
| Other | ammonium hydroxide | | | | | |
| | oleic acid | | 7 | | | |

| Function | Ingredient | Ex. 6 | Ex. 7 | Ex. 8 | Ex. 9 | Ex. 10 |
|---|---|---|---|---|---|---|
| Non-polar (aromatic) solvent | toluene | 30 | 40 | 46.2 | 44 | |
| | xylene | | | | | 34 |
| | Petroleum naphtha | | 0.2 | 0.21 | 0.199 | |
| Non-polar (aliphatic) solvent | Mineral oil | 0.78 | 1.05 | | | |
| Polar (aliphatic) solvent | isopropanol | 30 | 30 | 40.1 | 38 | 26.5 |
| | 2-ethylhexanol | | 0.78 | | | |
| | morpholine | | | | | 4.5 |
| | oleylamine | | 3 | | | |
| Water | distilled water | | 2 | | 3.7 | |
| Polyether component | BPEA | | | | | 20 |
| | PPEA | | 11 | 11.7 | 11 | |
| | PPE | 10 | | | | |
| Functional solvent | butyl cellosolve | 20 | | | | 15 |
| | n-methyl-2-pyrrolidone | | 3 | | | |
| | n-propyl acetate | 5 | | | | |
| Detergent | PIB-based Mannich detergent | | 2 (1.8) | 2.1 (1.89) | 1.995 (1.796) | |
| | PIB-based quaternary amine | | 3 (2.22) | | | |
| Corrosion inhibitor | naphthenic acid salt | | 3 (1.95) | | | |
| | triethanolamine | | 3 | | | |
| | dodecenyl succinic acid | | | | | |
| | PIB succinic acid | | | | | |
| Other | Ammonium Hydroxide | | | | 5(1.3) | |
| | Oleic acid | | | | | |

TABLE 2-continued

Fuel System Rail and Air Intake Cleaner Formulations

| Function | Ingredient | Ex. 11 | Ex. 12 | Ex. 13 | Ex. 14 | Ex. 15 |
|---|---|---|---|---|---|---|
| Non-polar (aromatic) solvent | toluene | | | | | |
| | xylene | 24 | 31 | 27 | 24 | 24 |
| | Petroleum naphtha | | | | | |
| Non-polar (aliphatic) solvent | Mineral oil | | | | | |
| Polar (aliphatic) solvent | isopropanol | 24.5 | 24.5 | 24.5 | 28 | 24.5 |
| | morpholine | 4.5 | 4.5 | 4.5 | 4.5 | 4.5 |
| | oleylamine | 3 | 3 | 3 | 3 | 3 |
| Water | distilled water | 3 | 3 | | 3 | 3 |
| Polyether component | BPEA | 20 | 15 | 20 | 20 | |
| | PPEA | | | | | 20 |
| | PPE | | | | | |
| Functional solvent | butyl cellosolve | 15 | 13 | 15 | 15 | 15 |
| | n-methyl-2-pyrrolidone | 3 | 3 | 3 | | 3 |
| | n-propyl acetate | | | | | |
| Detergent | PIB-based Mannich detergent | | | | | |
| | PIB-based quaternary amine | | | | | |
| Corrosion inhibitor | naphthenic acid salt | | | | | |
| | triethanolamine | 3 | 3 | 3 | 3 | 3 |
| | dodecenyl succinic acid | | | | | |
| | PIB succinic acid | | | | | |
| Other | ammonium hydroxide | | | | | |
| | Oleic acid | | | | | |

| Function | Ingredient | Ex. 16 | Ex. 17 | Ex. 18 | Ex. 19 |
|---|---|---|---|---|---|
| Non-polar (aromatic) solvent | toluene | 13.3 | | | 10 |
| | xylene | 19.5 | 18.0 | 10.0 | 19.2 |
| | Petroleum naphtha | | | | |
| Non-polar (aliphatic) solvent | Mineral oil | | | | |
| Polar (aliphatic) solvent | isopropanol | 17.6 | 18.4 | 10.0 | 29.6 |
| | morpholine | 4.3 | 3.4 | 5.0 | 3.6 |
| | oleylamine | 2.9 | 2.3 | 5.0 | 2.4 |
| | Alkarylamine | | | 5.0 | |
| Water | distilled water | 3.0 | 2.3 | 5.0 | 2.4 |
| Polyether component | BPEA | | | | |
| | PPEA | 19.2 | 15 | 10.0 | 16 |
| | PPE | | | | |
| Functional solvent | butyl cellosolve | 14.4 | 11.3 | 10.0 | 12 |
| | n-methyl-2-pyrrolidone | 2.9 | 2.3 | 10.0 | 2.4 |
| | n-propyl acetate | | | | |
| | acetone | | 25.0 | 10.0 | |
| Detergent | PIB-based Mannich detergent | | | 2.0 | |
| | PIB-based quaternary amine | | | | |
| Corrosion inhibitor | naphthenic acid salt | | | | |
| | triethanolamine | 2.9 | 2.3 | 5.0 | 2.4 |
| | dodecenyl succinic acid | | | | |
| | PIB succinic acid | | | | |
| | Isopropanolamine | | | 5.0 | |
| | Alkylsuccinylaminoester-carboxylic acid salt | | | 3.0 | |
| Other | Ammonium Hydroxide | | | 5.0 | |
| | Oleic acid | | | | |

Formulations 17-19 are particularly suited to use as air intake cleaners.

Performance testing is performed using two test vehicles. These two standard test vehicles are a 2011 Chevrolet HHR (PFI) and a 2008 Volkswagen Jetta (GDI). The Chevrolet facilitates measuring intake valve deposits (IVD) and combustion chamber deposits (CCD) cleanup (limited injector fouling) while the Jetta provides cleanup data of injector flow and CCD (limited IVD cleanup due to GDI design). Prior to testing in both vehicles, the engine is disassembled and its combustion chambers are completely cleaned. They were then reassembled with new spark plugs and new valves.

The vehicle is driven for 2500 miles on a specially formulated reference fuel obtained from Haltermann (an unleaded base gasoline containing no detergent additives) to build deposits. The driving cycle is otherwise as described in ASTM D5500-98(2014), Standard Test Method for Vehicle Evaluation of Unleaded Automotive Spark-Ignition Engine Fuel for Intake Valve Deposit Formation, ASTM International, West Conshohocken, Pa., 2014, DOI: 10.1520/D5500-98R14.

After the driving cycle, the engine is disassembled again and the deposits accumulated are measured and weighed. The engines are re-assembled and subjected to a fuel system cleaning procedure to remove the deposits. For this, the exemplary compositions are delivered to the fuel system using an apparatus as shown in FIG. 1 attached to the fuel rail. Before and after measurements are reported for intake valve deposits, piston top deposit thicknesses, and cylinder head deposit thicknesses. The percentage cleanup (% CU) results are calculated from these values as:

$$\frac{\text{value before cleanup} - \text{value after cleanup}}{\text{value before cleanup}} \times 100$$

In the equation above, the value can be a weight or a thickness. The results for some of the example compositions are summarized in TABLE 3. When comparing the % CU results, it is clear that the exemplary compositions outperform the comparative products (denoted Comp. Ex. A, Comp. Ex. B, and Comp. Ex. C). For IVD removal, the % CU results for the exemplary compositions range from 22-40% vs. 14-24% for the comparative products. For piston top deposit removal, the % CU results for the exemplary compositions range from 34-87% vs. 14-43% for the comparative products. For cylinder head deposit removal, the % CU for the exemplary compositions ranges from 46-65% vs. 10-30% for the comparative products. Av. CU is an average of the piston top and cylinder head percent CU.

TABLE 3

Dirty-Up/Clean-Up Fuel Rail Test Data (Chevrolet HHR)

| | Intake Valve | | | Piston Top | | | Cylinder Head | | | |
|---|---|---|---|---|---|---|---|---|---|---|
| | Before (mg) | After (mg) | % CU | Before (mm) | After (mm) | % CU | Before (mm) | After (mm) | % CU | Av. CU |
| **Comparative Products** | | | | | | | | | | |
| Ex. A | 282.1 | 241.6 | 14 | 0.123 | 0.106 | 14 | 0.180 | 0.153 | 15 | 14.5 |
| Ex. B | 260.5 | 203.7 | 22 | 0.157 | 0.122 | 23 | 0.211 | 0.191 | 10 | 16.5 |
| Ex. C | 302.0 | 231.0 | 24 | 0.147 | 0.084 | 43 | 0.196 | 0.137 | 30 | 36.5 |
| **Example Compositions** | | | | | | | | | | |
| Ex. 3 | 204.4 | 153.8 | 25 | 0.147 | 0.043 | 71 | 0.257 | 0.119 | 54 | 62.0 |
| Ex. 4 | 261.5 | 203.2 | 22 | 0.135 | 0.089 | 34 | 0.211 | 0.089 | 58 | 46.0 |
| Ex. 7 | 262.4 | 167.9 | 36 | 0.155 | 0.058 | 62 | 0.226 | 0.112 | 51 | 56.5 |
| Ex. 10 | 257.0 | 187.0 | 27 | 0.175 | 0.033 | 82 | 0.236 | 0.084 | 65 | 73.5 |
| Ex. 11 | 295.8 | 176.9 | 40 | 0.142 | 0.021 | 85 | 0.229 | 0.084 | 64 | 74.5 |
| Ex. 15 | 248.6 | 162.6 | 35 | 0.130 | 0.018 | 87 | 0.188 | 0.102 | 46 | 66.5 |
| Ex. 16 | 165.3 | 104.1 | 37 | 0.129 | 0.044 | 66 | 0.233 | 0.096 | 59 | 62.5 |
| Ex. 19 | 173.6 | 128.5 | 26 | 0.108 | 0.035 | 68 | 0.209 | 0.097 | 54 | 61.0 |

Testing in the Jetta is conducted to determine injector clean-up as the HHR did not provide injector fouling. The testing procedure follows that described for the Chevrolet. The results for some of the example compositions in the Jetta are summarized in TABLE 4.

TABLE 4

Dirty-Up/Clean-Up Fuel Rail Test Data (Volkswagen Jetta)

| | Fuel Injector Restriction | | | Piston Top | | | Cylinder Head | | | |
|---|---|---|---|---|---|---|---|---|---|---|
| | Before (%) | After (%) | % CU | Before (mm) | After (mm) | % CU | Before (mm) | After (mm) | % CU | Av. CU |
| **Comparative Products (Fuel Rail Testing)** | | | | | | | | | | |
| Ex. D | −3.39 | −0.64 | 81 | 0.146 | 0.017 | 88 | 0.161 | 0.050 | 69 | 78.5 |
| **Example Compositions (Fuel Rail Testing)** | | | | | | | | | | |
| Ex. 15 | −2.80 | −0.30 | 89 | 0.116 | 0.008 | 93 | 0.138 | 0.081 | 41 | 67 |
| Ex. 16 | −3.11 | −0.25 | 92 | 0.118 | 0.019 | 84 | 0.125 | 0.042 | 66 | 75 |

When comparing the % CU results for the cleanup in the Jetta, the exemplary compositions perform as well as the comparative product (denoted Comp. Ex. D). The injector flow is restored in all cases. For piston top deposit removal, the % CU results for the exemplary compositions range from 84-93% vs. 88% for the comparative product. For cylinder head deposit removal, the % CU for the exemplary compositions ranges from 46-65% vs. 69% for the comparative product. Av. CU is an average of the piston top and cylinder head percent CU.

Formulation 19 appears to be particularly suited to use as an air intake cleaner in tests run on vehicles with direct injection engines (the formulation can also be used with port fuel injection to provide further air-intake clean-up). TABLE 5 below illustrates the clean-up observed in the Jetta during air-intake cleaning. This evaluation illustrates directional clean-up performance on the intake valves and follows the procedure described above for the Chevrolet.

TABLE 5

Dirty-Up/Clean-Up Air-Intake Test Data (Volkswagen Jetta)

| | Intake Valve | | | Piston Top | | | Cylinder Head | | | |
|---|---|---|---|---|---|---|---|---|---|---|
| | Before (mg) | After (mg) | % CU | Before (mm) | After (mm) | % CU | Before (mm) | After (mm) | % CU | Av. CU |
| Comparative Products | | | | | | | | | | |
| Ex. D | 400.3 | 361.8 | 10 | 0.092 | 0.040 | 57 | 0.077 | 0.048 | 38 | 47.5 |
| Ex. E | 570.1 | 524.2 | 8 | 0.125 | 0.077 | 38 | 0.124 | 0.050 | 60 | 49 |
| Ex. F | 313.1 | 285.3 | 9 | 0.031 | 0.028 | 10 | 0.049 | 0.032 | 35 | 22.5 |
| Example Compositions | | | | | | | | | | |
| Ex. 17 | 559.0 | 431.5 | 23 | 0.128 | 0.085 | 34 | 0.151 | 0.102 | 32 | 33 |
| Ex. 18 | 427.6 | 304.9 | 29 | 0.122 | 0.109 | 11 | 0.120 | 0.122 | −2 | 4.5 |
| Ex. 19 | 706.6 | 603.2 | 15 | 0.094 | 0.027 | 71 | 0.073 | 0.037 | 49 | 60 |

When comparing the Intake Valve % CU results, it is clear that the exemplary compositions outperform the comparative products (denoted Comp. Ex. D, Comp. Ex. E, and Comp. Ex. F). For IVD removal, the % CU results for the exemplary compositions range from 9-29% vs. 8-10% for the comparative products.

Performance testing was also conducted in field vehicles. These vehicles are current market representative vehicles equipped with port fuel injection or direct injection fuel delivery systems. The vehicles listed in TABLE 6 had unaltered "as is" deposits and were selected from Texas and Ohio vehicle markets. Clean-up testing measurements are conducted as previously described for performance testing in the 2011 Chevrolet HHR. The following vehicles (engine size, engine type, injector type, and mileage shown in parenthesis) were tested:

Vehicle A: 2008 Jeep Compass (2.4 L I-4, PFI, 96.3K miles)

Vehicle B: 2004 Chevrolet Suburban (8.2 L V8, PFI, 87.7K miles)

Vehicle C: 2012 Ford Edge (2.0 L turbo I-4, GDI, 31.8K miles)

Vehicle D: 2013 Kia Sportage (2.0 L turbo I-4, GDI, 54.6K miles)

Vehicle E: 2013 Chevrolet Impala (3.6 L V6, GDI, 43.7K miles)

Vehicle F: 2014 Chevrolet Camaro (3.6 L V6, GDI, 22.8K miles)

Vehicle G: 2011 Hyundai Sonata (2.4 L I-4, GDI, 67.1K miles)

Vehicle H: 2011 Chevrolet Equinox (2.4 L I-4, GDI, 98.7K miles)

Vehicle I: 2013 Honda Accord (2.4 L I-4, GDI, 29.6K miles)

Vehicle J: 2013 Kia Soul (1.6 L I-4, GDI, 65.6K miles)

Vehicle K: 2012 Ford Focus (2.0 L I-4, GDI, 89.5K miles)

Vehicle L: 2011 Audi A4 (2.0 L turbo I-4, GDI, 67.5K miles)

Vehicle M: 2013 Ford F-150 (3.5 L twin turbo V6, GDI, 82.0K miles)

Vehicle N: 2013 Mini Cooper S (1.6 L turbo I-4, GDI, 27.6K miles)

Vehicle O: 2012 Mini Cooper Countryman (1.6 L turbo I-4, GDI, 68.7K miles)

TABLE 6

Field Vehicle Clean-Up Test Data

| | Air Intake Valve | | | Piston Top | | | Cylinder Head | | | |
|---|---|---|---|---|---|---|---|---|---|---|
| | Before (mg) | After (mg) | % CU | Before (mm) | After (mm) | % CU | Before (mm) | After (mm) | % CU | Av. CU |
| Fuel Rail Testing (Example 16) | | | | | | | | | | |
| Veh. A | 144.2 | 128.1 | 11 | 0.019 | 0.006 | 68 | 0.033 | 0.004 | 88 | 78.0 |
| Veh. B | 355.1 | 293.4 | 17 | 0.092 | 0.060 | 35 | 0.090 | 0.056 | 38 | 36.5 |
| Veh. C | 510.3 | 443.0 | 13 | 0.063 | 0.050 | 21 | 0.032 | 0.015 | 53 | 37.0 |
| Veh. D | 730.7 | 853.1 | −17 | 0.044 | 0.021 | 52 | 0.082 | 0.014 | 83 | 67.5 |
| Air-Intake Testing (Example 19) | | | | | | | | | | |
| Veh. E | 598 | 274 | 54 | 0.063 | 0.033 | 48 | 0.062 | 0.033 | 46 | 47.0 |
| Veh. F | 126 | 56 | 55 | 0.033 | 0.019 | 42 | 0.042 | 0.028 | 34 | 38.0 |

TABLE 6-continued

| Field Vehicle Clean-Up Test Data | | | | | | | | | | |
|---|---|---|---|---|---|---|---|---|---|---|
| | Air Intake Valve | | | Piston Top | | | Cylinder Head | | | |
| | Before (mg) | After (mg) | % CU | Before (mm) | After (mm) | % CU | Before (mm) | After (mm) | % CU | Av. CU |
| Veh. G | 606 | 424 | 30 | 0.035 | 0.005 | 87 | 0.080 | 0.040 | 50 | 68.5 |
| Veh. H | 675 | 365 | 46 | 0.060 | 0.015 | 75 | 0.126 | 0.045 | 64 | 69.5 |
| Veh. I | 156 | 66 | 58 | 0.024 | 0.011 | 54 | 0.047 | 0.032 | 32 | 43.0 |
| Veh. J | 197 | 104 | 47 | 0.060 | 0.050 | 18 | 0.088 | 0.031 | 65 | 41.5 |
| Veh. K | 371 | 158 | 57 | 0.022 | 0.019 | 13 | 0.072 | 0.054 | 26 | 19.5 |
| Veh. L | 375 | 271 | 28 | 0.038 | 0.008 | 80 | 0.016 | 0.011 | 33 | 56.5 |
| Veh. M | 351 | 149 | 58 | 0.036 | 0.017 | 52 | 0.026 | 0.022 | 15 | 33.5 |
| Combination Testing (Examples 16 & 19) | | | | | | | | | | |
| Veh. N | 100 | 25 | 75 | 0.026 | 0.009 | 65 | 0.045 | 0.027 | 40 | 52.5 |
| Veh. O | 123 | 35 | 72 | 0.051 | 0.006 | 88 | 0.044 | 0.011 | 75 | 81.5 |

Average % CU is an average of the piston top and cylinder head percent CU for the first 13 vehicles. When comparing the average % CU results, it is clear that the exemplary compositions provide outstanding performance data in many varying field vehicles. For IVD removal, the average % CU results for the exemplary compositions is 40.9%. For piston top deposit removal, the average % CU results for the exemplary compositions is 54.6%. For cylinder head deposit removal, the average % CU for the exemplary compositions is 51.3%.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A combustible composition for cleaning fuel delivery systems, air intake systems, and combustion chambers comprising:

at least 10 wt. % of a polyether component, the polyether component being selected from the group consisting of polyethers, polyetheramines, and mixtures thereof;

at least 20 wt. % of a polar solvent, other than an alkoxyalcohol, the polar solvent being selected from the group consisting of aliphatic polar solvents, aromatic polar solvents, and mixtures thereof, the polar solvent comprising an aliphatic polar solvent selected from the group consisting of $C_1$-$C_{12}$ aliphatic alcohols, $C_1$-$C_{12}$ aliphatic amines, $(C_1$-$C_{12}$ alkyl$)_2O$ ethers, and mixtures thereof, the aliphatic polar solvent comprising at least 80 wt. % of the polar solvent;

at least 15 wt. % of a non-polar solvent, the non-polar solvent comprising a non-polar aromatic solvent consisting essentially of aromatic hydrocarbons, the non-polar aromatic solvent being at least 15 wt. % of the composition;

at least 5 wt. % of a functional solvent, other than the polar solvent and non-polar aromatic solvent, the functional solvent comprising an alkoxyalcohol, the alkoxyalcohol being at least 5 wt. % of the composition; and no more than 10 wt. % water, wherein the polyether component, polar solvent, and non-polar solvent total at least 70 wt. % of the composition.

2. The composition of claim 1, wherein the polyether component comprises a poly(alkylene oxide)amine.

3. The composition of claim 2, wherein the alkylene oxide in the poly(alkylene oxide)amine is selected from butylene oxide, propylene oxide, and mixtures thereof.

4. The composition of claim 1, wherein the polyether or polyetheramine is represented by the formula $R[OCH_2CH(R^1)]_nA$, where R is a hydrocarbyl group, $R^1$ is selected from hydrogen and a hydrocarbyl group, A is a nitrogen-containing group or a hydroxyl group, and n is a number which is at least 2.

5. The composition of claim 4, wherein R is a hydrocarbyl group of 1-30 carbon atoms.

6. The composition of claim 4, wherein n is at least 10.

7. The composition of claim 4, wherein A is selected from the group consisting of amines, ether amines and mixtures thereof.

8. The composition of claim 7, wherein A is selected from $—OCH_2CH_2CH_2NR^2R^2$ and $NR^3R^3$, where each $R^2$ is independently hydrogen or a hydrocarbyl group of one or more carbon atoms, and each $R^3$ is independently hydrogen, a hydrocarbyl group of one or more carbon atoms, or $—[R^4(R^5)]_pR^6$, where $R^4$ is a $C_2$-$C_{10}$ alkylene, $R^5$ and $R^6$ are independently hydrogen or a hydrocarbyl group of one or more carbon atoms, and p is a number from 1 to 7.

9. The composition of claim 1, wherein at least 20 wt. % of the polyether component is polyetheramine.

10. The composition of claim 1, wherein a ratio, by weight, of the aliphatic polar solvent to the non-polar aromatic solvent in the composition is at least 1:5.

11. The composition of claim 1, wherein the aliphatic polar solvent is selected from the group consisting of branched and unbranched $C_1$-$C_{12}$ aliphatic alcohols, $C_1$-$C_{12}$ aliphatic amines, and mixtures thereof.

12. The composition of claim 1, wherein the non-polar aromatic solvent comprises a hydrocarbon selected from $C_1$-$C_4$ alkyl substituted benzenes and mixtures thereof.

13. The composition of claim 1, wherein the non-polar aromatic solvent has a Hansen solubility parameter of up to 2 $MPa^{1/2}$ and the aliphatic polar solvent has a Hansen solubility parameter of at least 2.8 $MPa^{1/2}$.

14. The composition of claim 1, wherein in combination, the polyether component, aliphatic polar solvent, and non-polar aromatic solvent are at least 75 wt. % of the composition.

15. The composition of claim 1, wherein the alkoxyalcohol is present in the composition at a concentration of at least 10 wt. %.

16. The composition of claim 1, wherein the alkoxyalcohol comprises 2-butoxy ethanol.

17. The composition of claim 1, wherein the functional solvent has a solubility of at least 10 parts by weight of functional solvent in the aliphatic polar solvent and in the non-polar aromatic solvent.

18. The composition of claim 1, further comprising at least one of a detergent, a dispersant, a corrosion inhibitor and a propellant.

19. The composition of claim 1, wherein the composition comprises at least 0.5 wt. % water.

20. A method for removing at least one of air intake valve deposits, fuel injector deposits, and combustion chamber deposits in a spark-ignited internal combustion engine, comprising:

delivering a composition according to claim 1 into the engine.

21. The composition of claim 1, comprising no more than 5 wt. % water.

22. The composition of claim 1, wherein at least 70 wt. % of the polyether component is polyetheramine.

23. The composition of claim 1, wherein the composition comprises 20-40 wt. % non-polar aromatic solvent.

24. The composition of claim 11, wherein the aliphatic polar solvent comprises a $C_2$-$C_4$ aliphatic alcohol.

25. An engine cleaning composition comprising:

15-23 wt. % of a polyether component, the polyether component being selected from the group consisting of polyethers, polyetheramines, and mixtures thereof;

10-30 wt. % of a functional solvent, the functional solvent comprising an alkoxyalcohol selected from the group consisting of butyl glycol, ethoxypropanol, and mixtures thereof, the alkoxyalcohol being at least 10 wt. % of the composition;

20-35 wt. % of a aliphatic polar solvent, other than the functional solvent, said aliphatic polar solvent selected from the group consisting of $C_1$-$C_{12}$ aliphatic alcohols, $C_1$-$C_{12}$ aliphatic amines, $(C_1$-$C_{12}$ alkyl$)_2O$ ethers, and mixtures thereof; and 20-40 wt. % of a non-polar aromatic solvent, other than the functional solvent, wherein the polyether component, aliphatic polar solvent, and non-polar aromatic solvent total at least 70 wt. % of the composition.

* * * * *